United States Patent [19]

Frey et al.

[11] 4,030,463

[45] June 21, 1977

[54] INTERNAL COMBUSTION ENGINE WITH RETURN LINE FOR EXHAUST GASES

[75] Inventors: Jurgen Frey, Stuttgart; Andreas Weber, Lorch; Adolf Triffterer, Nurtingen, all of Germany

[73] Assignee: Daimler-Benz Aktiengesellschaft, Germany

[22] Filed: Aug. 2, 1974

[21] Appl. No.: 494,761

[30] Foreign Application Priority Data

Aug. 4, 1973 Germany ..... 2339626

[52] U.S. Cl. ..... 123/119 A

[51] Int. Cl.[2] ..... F02M 25/06

[58] Field of Search ..... 123/119 A, 119 B; 251/305, 205, 208

[56] References Cited

UNITED STATES PATENTS

| | | | |
|---|---|---|---|
| 2,154,417 | 4/1939 | Anderson | 123/119 A |
| 2,174,547 | 10/1939 | Bailey | 251/305 |
| 3,542,003 | 10/1970 | Sarto | 123/119 |
| 3,648,672 | 3/1972 | Muroki et al. | 123/119 A |
| 3,677,240 | 7/1972 | Sarto | 123/119 B |
| 3,712,281 | 1/1973 | Ruth | 123/119 B |
| 3,730,156 | 5/1973 | Sarto | 123/119 A |
| 3,800,765 | 4/1974 | Thompson | 123/119 A |
| 3,802,402 | 4/1974 | Swatman | 123/119 A |
| 3,812,832 | 5/1974 | Scott | 123/119 A |
| 3,827,412 | 8/1974 | Waitzman | 123/119 A |
| 3,827,414 | 8/1974 | Sarto | 123/119 A |
| 3,842,814 | 10/1974 | Bier | 123/119 A |
| 3,888,459 | 6/1975 | Bubniak | 251/208 |

*Primary Examiner*—Wendell E. Burns
*Attorney, Agent, or Firm*—Craig & Antonelli

[57] ABSTRACT

An internal combustion engine with a return line for exhaust gases which connects the exhaust system with an inlet line provided with a throttle valve; the orifice of the return line in the inlet line is thereby located within the control cross section of the inlet line so that with a closed and substantially closed throttle valve, the orifice is upstream of the throttle valve whereas with an opened or substantially opened throttle valve, it is disposed downstream thereof.

19 Claims, 6 Drawing Figures

FIG. 1
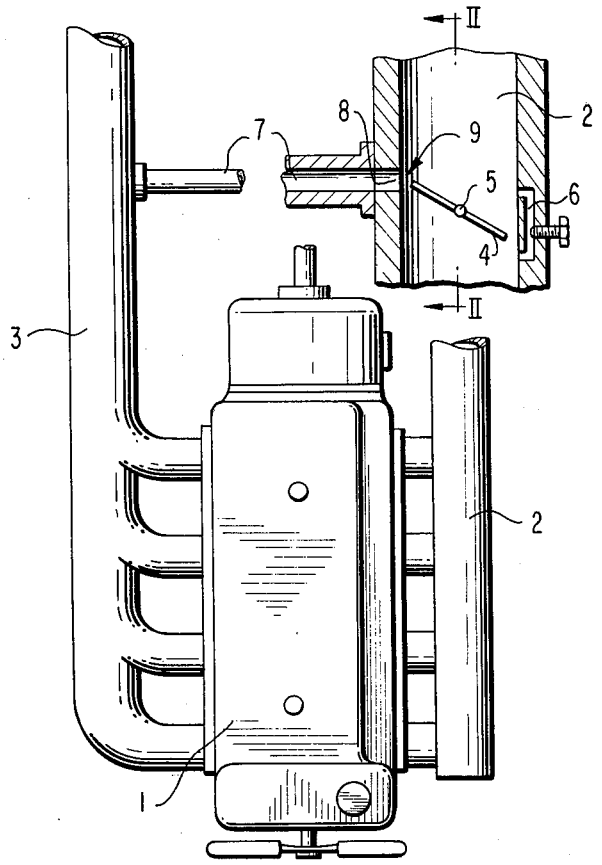
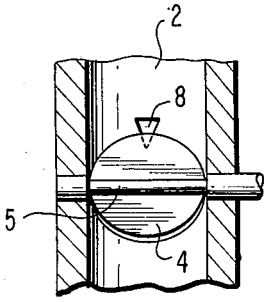
FIG. 2

INTERNAL COMBUSTION ENGINE WITH RETURN LINE FOR EXHAUST GASES

The present invention relates to an internal combustion engine with a return line for exhaust gases, which connects the exhaust system with an inlet line provided with a throttle valve, whereby the control cross section in the inlet line for the exhaust gas quantity to be conducted back, with a closed and substantially closed throttle valve, is disposed upstream of the throttle valve as well as with an opened and substantially opened throttle valve, is disposed downstream thereof. 2,034,930With such a known internal combustion engine (German Offenlegungsschrift Pat. No. 2,034,930), a nozzle with a closure member is disposed in the return line, whereby the closure member under the influence of a return means and of a pneumatic device operating with the aid of vacuum is in communication with a working chamber. This working chamber is connected with at least one pressure tap opening in the wall of the inlet line within the mentioned control cross section. With a closed and substantially closed throttle valve, the pressure tap opening is at external, atmospheric pressure and with widely opened throttle valve under the only slight vacuum in the inlet line so that the closure member keeps the return line closed. In the intermediate positions of the throttle valve, the pressure tap opening is under a considerable vacuum so that the return line is opened and exhaust gases can be sucked into the inlet line.

The present invention is concerned with the task to considerably simplify the system for the return of the exhaust gases.

The underlying problems are solved according to the present invention in that the orifice of the return line is disposed in the inlet line within the control cross section.

With the internal combustion engine constructed according to the present invention, the quantity of returned exhaust gases is controlled directly at the place at which the exhaust gases flow into the inlet line. The control parts such as nozzle with closure member, pneumatic device with working chamber and return means as well as a separate control line can be economized. The installation according to the present invention also operates with a lesser delay in case of a change of the throttle valve position since the pressure in the control cross section is effective directly on the exhaust gas quantity which is conducted back by way of the return line.

In one advantageous embodiment of the present invention, the orifice has a circularly shaped, elongated or wedge-shaped profile which is disposed either parallel or perpendicular to the throttle valve shaft. This construction of the orifice enables a variation of the dependency of the returned exhaust gas quantity from the throttle valve position, i.e., an adaptation of the exhaust gas quantity to the requirements.

Accordingly, it is an object of the present invention to provide an internal combustion engine with a return line for exhaust gases which avoids by simple means the aforementioned shortcomings and drawbacks encountered in the prior art.

Another object of the present invention resides in a system for the return of exhaust gases from the exhaust line to the inlet line of an internal combustion engine which is considerably simplified, obviating the need for separate, costly control parts.

A further object of the present invention resides in a system for the return of exhaust gases from the exhaust system to the inlet side of an internal combustion engine in which the quantity of returned exhaust gases is controlled directly at the location where the exhaust gases flow into the inlet line.

Still another object of the present invention resides in an internal combustion engine with a return system for exhaust gases which dispenses with the need of separate control parts, thereby not only simplifying the installation but reducing the cost thereof.

Another object of the present invention resides in a system for the return of the gases of the type described above which operates with lesser delay in case of a change in the position of the throttle valve.

A further object of the present invention resides in a system for the return of the exhaust gases of an internal combustion engine in which the quantity of exhaust gases can be readily adapted to the requirements of a given engine.

These and further objects, features and advantages of the present invention will become more apparent from the following description when taken in connection with the accompanying drawing which shows, for purposes of illustration only, several embodiment in accordance with the present invention, and wherein:

FIG. 1 is a plan view, partly in cross section, of an internal combustion engine with an inlet and exhaust system in accordance with the present invention;

Figure 2A:
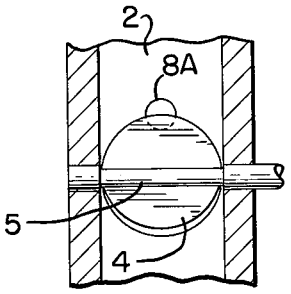
FIG. 2 is a cross-sectional view, taken along line II-II through the inlet line of FIG. 1 and FIGS. 2A–2D are cross-sectional views of the inlet line including profiled exhaust orifices in accordance with the present invention.

Referring now to the drawing wherein like reference numerals are used throughout the two views to designate like parts, an inlet 2 and an exhaust line 3 are connected to the internal combustion engine 1. A throttle valve 4 with a throttle valve shaft 5 is provided in the inlet line 2. An idling channel is designated by reference numberal 6.

The inlet line 2 is connected with the exhaust line 3 by way of a return line 7 for exhaust gases. The orifice 8 of the return line 7 in the inlet line 2 lies within the control cross section 9 which, with a closed or substantially closed throttle valve 4, is disposed upstream thereof, and more particularly on that side of the inlet line 2, on which the throttle valve moves upstream in its opening movement. In these positions of the throttle valve 4, the orifice 8 is under the outside pressure, i.e., under atmospheric pressure so that practically no exhaust gases are sucked into the inlet line 2 by way of the return line 7.

With a slightly opened throttle valve 4, corresponding to a slight partial load, the part of the throttle valve 4 which is disposed farthest upstream, is located in the control cross section 9. The gases flowing past the throttle valve 4 and therewith past the orifice 8 have a high velocity and low pressure so that a larger quantity of exhaust gases is sucked in. This exhaust gas quantity can be matched to the requirements by the configuration of the profile of the orifice 8. In FIG. 2, for example, a wedge-shaped profile is shown whose longitudinal axis is disposed perpendicular to the throttle valve shaft 5 and parallel to the flow direction in the inlet line 2. The apex or tip of the arrow is disposed downstream, i.e., points in the downstream direction. With the throttle valve position illustrated in FIG. 2, the largest portion of the orifice area lies upstream of the throttle valve 4 so that the orifice 8 is still widely subjected to the outside pressure. With this orifice profile, a smaller amount of exhaust gases is thus sucked in than if an orifice 8A was provided having a circular shape such as shown in FIG. 2A.

During a further opening of the throttle valve 4 corresponding to a larger partial load, the orifice 8 comes to lie completely downstream of the throttle valve 4 and thus is under a lower suction pressure. In this throttle valve position, the largest exhaust gas quantity is sucked in.

With a complete or nearly complete throttle valve opening, the pressue downstream of the throttle valve 4 increases to the atmospheric or outside pressure so that the sucked-in exhaust gas quantity again is very low.

Figure 2B:
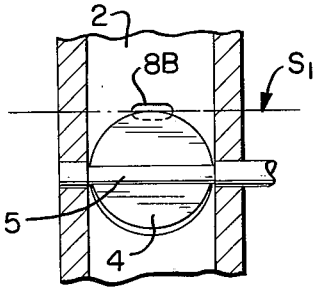
Figure 2C:
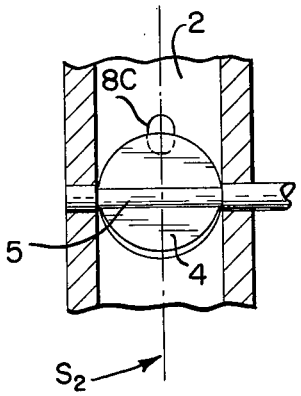
Figure 2D:
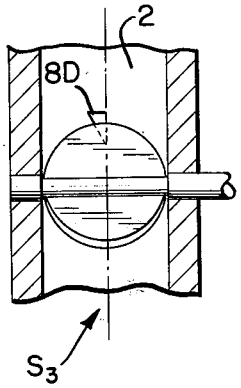

As shown in FIG. 2B the orifice 8B may have an elongated profile which is substantially symmetrical with respect to an axis of symmetry $S_1$ disposed parallel to the throttle valve shaft 5. To provide a further variation in the amount of exhaust gases, an orifice 8C may be provided in the inlet line having an elongated profile which is substantially symmetrical with respect to an axis of symmetry $S_2$ disposed perpendicular to the throttle valve shaft 5. Additionally, an orifice 8D may be provided as the discharge opening of the return line 7 which has a substantially asymmetrical configuration with respect to either an axis of symmetry $S_3$ disposed substantially perpendicular to the throttle valve shaft 5 or an axis of symmetry disposed parallel to the valve shaft 5. These various constructions of the orifices 8–8D are FIGS. 2–2D enable a variation of the quantity of returned exhaust gas in dependence upon the position of the throttle valve 4 thereby facilitating the adaptation of the specific exhaust gas requirements for an internal combustion engine.

While we have shown and described only several embodiment in accordance with the present invention, it is understood that the same is not limited thereto but is susceptible of numerous changes and modifications as known to those skilled in the art, and we therefore do not wish to be limited to the details shown and described herein but intend to cover all such changes and modifications as are encompassed by the scope of the appended claims.

We claim:

1. An internal combustion engine with a return line for returning gases from an exhaust system of the engine to an inlet line provided with a throttle valve means, the inlet line being provided with a control cross-section for controlling the exhaust gas quantity to be conducted back into the engine, the control cross section being disposed upstream of the throttle valve means with a closed and substantially closed throttle valve and being disposed downstream of the throttle valve means with an open throttle valve means, characterized in that the return line means terminates in a control orifice disposed in the control cross section of the inlet line, the control orifice directly supplying the exhaust gases from the exhaust system to the inlet line such that with a slightly open throttle valve means corresponding to a partial load of the engine the exhaust gases from the exhaust system are supplied from said control orifice directly into the control cross-section of the inlet line whereby the exhaust gases are intermixed with inlet gases at the throttle valve means with the quantity of the exhaust gas flow into the control cross-section being solely determined by the position of the throttle valve means and the configuration of the control orifice.

2. An internal combustion engine according to claim 1, characterized in that the control orifice has a substantially circular profile.

3. An internal combustion engine according to claim 1, characterized in that the control orifice has a substantially elongated profile.

4. An internal combustion engine according to claim 1, characterized in that the control orifice has a wedge-shaped profile.

5. An internal combustion engine according to claim 4, characterized in that the tip of the wedge-shaped profile points in the direction of flow.

6. An internal combustion engine according to claim 1, characterized in that the profile of the control orifice is disposed parallel to the throttle valve shaft.

7. An internal combustion engine according to claim 6, characterized in that the control orifice has a substantially elongated profile.

8. An internal combustion engine according to claim 6, characterized in that the control orifice has a wedge-shaped profile.

9. An internal combustion engine according to claim 1, characterized in that the profile of the control orifice is disposed substantially perpendicularly to the throttle valve shaft.

10. An internal combustion engine according to claim 9, characterized in that the control orifice has a substantially elongated profile.

11. An internal combustion engine according to claim 9, characterized in that the control orifice has a wedge-shaped profile.

12. An internal combustion engine comprising: inlet line means and exhaust gas line means, a return line means operatively connecting the exhaust gas line means with the inlet line means for conducting back a quantity of exhaust gases from the exhaust gas line means to the inlet line means, the inlet line means being provided with a control cross-section for controlling the amount of combustion air flowing into the engine, a throttle valve means provided in said control cross-section, and means for controlling the amount of exhaust gases sucked into the inlet line means by way of said return line means directly as a function of the vacuum in the control cross-section including a discharge opening provided on the return line means, the discharge opening being disposed in said control cross-section of the inlet line means such that with a slightly open throttle valve means corresponding to a partial load of the engine the exhaust gases from the exhaust line means are supplied through said discharge opening directly into said control cross-section of the inlet line means whereby the exhaust gases are intermixed with the combustion air flowing into the engine at the throttle valve means with the quantity of exhaust gas flow into the control cross-section being solely determined by the position of the throttle valve means and the configuration of the discharge opening.

13. An internal combustion engine according to claim 12, characterized in that the throttle valve means has an upstream edge and a downstream edge, the discharge opening of the return line means being disposed in the control cross section of the throttle valve means in such a manner that with a closed and substantially closed throttle valve means the discharge opening is disposed upstream of the upstream edge of the throttle valve means whereas with substantially opened and wide open throttle valve means, the discharge opening is disposed downstream of the upstream edge of the throttle valve means.

14. An internal combustion engine according to claim 12, characterized in that the discharge opening has a substantially symmetrical configuration.

15. An internal combustion engine according to claim 14, characterized in that the configuration of the discharge opening is substantially symmetrical with respect to an axis of symmetry disposed parallel to the throttle valve shaft.

16. An internal combustion engine according to claim 14, characterized in that the configuration of the discharge opening is substantially symmetrical with respect to an axis of symmetry disposed perpendicular to the throttle valve shaft.

17. An internal combustion engine comprising: inlet and exhaust line means and a return line means operatively connecting the exhaust line means with the inlet line means for conducting back a quantity of exhaust gases from the exhaust line means to the inlet line means, the inlet line means being provided withe a control cross section for controlling the amount of combustion air flowing into the engine, and means for controlling the amount of exhaust gases sucked into the inlet line means by way of said return line means directly as a function of the vacuum in said control cross section, the discharge opening of the return line means is disposed in said control cross-section, and the discharge opening of the return line means has a substantially asymmetrical configuration with respect to at least one axis.

18. An internal combustion engine according to claim 17, wherein said axis is disposed substantially parallel to the throttle valve shaft.

19. An internal combustion engine according to claim 17, wherein said axis is disposed substantially perpendicular to the throttle valve shaft.

* * * * *